United States Patent [19]

Müller et al.

[11] Patent Number: 4,589,989

[45] Date of Patent: May 20, 1986

[54] LAUNDRY SOFTENER CONCENTRATE

[75] Inventors: Karl-Hans Müller, Bruchköbel; Manfred Diehl, Frankfurt, both of Fed. Rep. of Germany

[73] Assignee: Degussa Aktiengesellschaft, Frankfurt, Fed. Rep. of Germany

[21] Appl. No.: 672,164

[22] Filed: Nov. 16, 1984

Related U.S. Application Data

[63] Continuation of Ser. No. 555,797, Nov. 28, 1983, abandoned.

[30] Foreign Application Priority Data

Nov. 27, 1982 [DE] Fed. Rep. of Germany ..... 3243983

[51] Int. Cl.[4] ..... C11D 1/62; C11D 7/02

[52] U.S. Cl. ..... 252/8.75; 252/8.8; 252/174.25

[58] Field of Search ..... 252/8.6, 8.75, 8.8, 252/8.9, 174.13, 174.25, 91

[56] References Cited

U.S. PATENT DOCUMENTS

| | | | |
|---|---|---|---|
| 3,095,373 | 6/1963 | Blomfield | 252/8.8 |
| 3,533,942 | 10/1970 | Rhees et al. | 252/8.8 |
| 3,546,115 | 12/1970 | Gill et al. | 252/8.8 |
| 3,573,091 | 3/1971 | Waldman et al. | 252/8.8 |
| 3,977,980 | 8/1976 | Fry et al. | 252/8.8 |
| 4,001,123 | 1/1977 | Renold | 252/8.8 |
| 4,126,562 | 11/1978 | Goffinet et al. | 252/8.8 |
| 4,155,855 | 5/1979 | Goffinet et al. | 252/8.8 |
| 4,199,465 | 4/1980 | Rodriguez | 252/91 |
| 4,255,294 | 3/1981 | Rudy et al. | 252/524 |
| 4,338,204 | 7/1982 | Spadini et al. | 252/8.75 |
| 4,392,965 | 7/1983 | Woodward et al. | 252/8.8 |
| 4,417,999 | 11/1983 | Duffy | 252/383 |
| 4,510,073 | 7/1985 | Hara | 264/117 |

FOREIGN PATENT DOCUMENTS

| | | |
|---|---|---|
| 3243983 | 5/1984 | Fed. Rep. of Germany . |
| 3402437 | 7/1985 | Fed. Rep. of Germany . |
| 137398 | 8/1982 | Japan . |

*Primary Examiner*—Prince E. Willis

*Attorney, Agent, or Firm*—Beveridge, DeGrandi & Weilacher

[57] ABSTRACT

A laundry softener concentrate comprises one or more laundry softeners, synthetic silicon dioxide, and optionally one or more solubilizers. The laundry softener concentrate is in the form of a flowable powder.

21 Claims, No Drawings

LAUNDRY SOFTENER CONCENTRATE

This is a continuation of application Ser. No. 555,797, filed Nov. 28, 1983, now abandoned.

The present invention relates to a laundry softener concentrate.

Laundry softeners are added to washing liquids to improve hand and to increase the softness of textile fabrics washed therein. Such softeners most usually are cationic tetraalkylammonium compounds and imidazoline derivatives, the effectiveness of which depends on the chemical nature of the alkyl groups.

Since, because of these long-chain alkyl residues, these laundry softeners are not soluble in water, they are conventionally marketed in the form of a 5%–8% by weight aqueous dispersion. This great dilution has obvious economic disadvantages. Large, unweildy and expensive packages are necessary, and above all a great deal of water must be transported. Furthermore, any conceivable automatic metering into a household washing machine is made difficult by the large volume of the required tank.

It is known to use laundry softener concentrates which likewise are dispersions and have a softener content of 15%–30% by weight. However, these known laundry softener concentrates have an exponential increase of viscosity with concentration (Tenside Detergents 18 (1981) 5, pp. 243–246).

The object of the present invention is a laundry softener concentrate which comprises a mixture of one or more laundry softeners, synthetic silicon dioxide and, if necessary, one or more solubilizers for the laundry softener or softeners used.

The laundry softener concentrate of the present invention will contain a sufficient amount of synthetic silicon dioxide whereby the concentrate is in the form of a free-flowing powder. Generally, the concentrate will contain from about 49% to about 75% by weight laundry softener and from about 25% to about 51% by weight synthetic silicon dioxide.

In a particular embodiment of the invention, the laundry softener concentrate can consist of the laundry softener and up to 50% by weight synthetic silicon dioxide alone. In a preferred embodiment, the laundry softener concentrate can contain 30–35% by weight of synthetic silicon dioxide. The content of active material then amounts to up to 70% by weight.

As synthetic silicon dioxides there can be used, as well as oven-dried and milled precipitated silicon dioxides, spray-dried precipitated silicon dioxides, which are either milled or not milled. In addition, silicon dioxides produced by high temperature hydrolysis (pyrogenically produced) can be utilized.

The cationic laundry softeners present in the laundry softener concentrate according to the invention are commercially known products. Preferably cationic nitrogen-containing compounds are used, such as quaternary ammonium compounds and amine salts, which possess one or two straight-chain organic residues containing at least 8 carbon atoms, of which residues advantageously at least one contains 12–22 carbon atoms. There are preferred as laundry softeners in the composition according to the invention, quaternary ammonium compounds having the following formula:

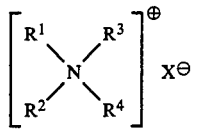

wherein $R^1$ is a long-chain aliphatic residue containing 8–22 carbon atoms or a fatty acid ester group, $R^2$ is a long-chain aliphatic residue containing 8–22 carbon atoms or an alkyl residue containing 1–6 carbon atoms or an aryl, aryloxy, alkoxy or aralkyl residue containing 6–28 carbon atoms or a fatty acid ester group, $R^3$ and $R^4$ are alkyl or hydroxyalkyl residues containing 1–6 carbon atoms or hydroxypolyalkoxyalkyl residues containing 4–20 carbon atoms, and X denotes an anion forming a water-soluble salt, such as, for example, a halide (chloride, bromide, iodide), sulfate, methosulfate, acetate, hydroxide anion, or a similar inorganic solubilizing mono- or dibasic group. The nitrogen can be a ring nitrogen, and the residues $R^2$ and $R^3$ can be replaced by a ring formed from 4 or 5 carbon atoms. Particularly good results are obtained with compounds of the given formula which have straight-chain alkyl residues, e.g., alkyl residues, as each of the residues $R^1$, $R^2$, $R^3$ and $R^4$. Examples of quaternary ammonium compounds which are very suitable as laundry softeners in the laundry softener concentrate according to the invention include: hydrogenated ditalloildimethylammonium chloride; ethoxylated distearyldimethylammonium chloride; dimethyldistearylammonium chloride; trimethylstearylammonium bromide; cetyltrimethylammonium chloride; dicocodimethylammonium chloride; cetylpyridinium chloride; alkyldimethylbenzylammonium chloride containing higher alkyl groups; diisobutyl-phenoxyethyldimethylbenzylammonium chloride; laurylisoquinolinium bromide; distearyldimethylammonium methosulfate; dimethyl-diarchidylbehenylammonium chloride; di(soya)-dimethylammonium chloride; and stearyldimethylbenzylammonium chloride.

Compounds of the following formula are also usable as laundry softeners:

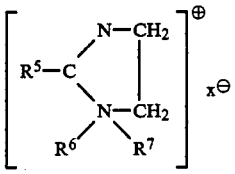

in which $R^5$ is a long-chain aliphatic residue containing 8–22 carbon atoms, $R^6$ is an alkyl residue containing 1–6 carbon atoms, $R^7$ is an alkylamido residue containing 8–22 carbon atoms or a hydroxyalkyl residue containing 2–6 carbon atoms. Examples of these compounds include 2-heptadecyl-1-methyl-1-[(stearylamido)-ethyl-]imidazoline methyl sulfate and 2-heptadecyl-1-hydroxyethyl-imidazoline chloride.

Examples of amines which can be used in the form of their water-soluble salts in the laundry softener according to the invention are primary tall oil amine, primary coco amine, primary hydrogenated tall oil amine, tall oil-1,3-propylenediamine, oleyl-1,3-propylenediamine, and coco-1,3-propylenediamine. The water-soluble salts of the amines disclosed above which are particularly suitable are, e.g., the sulfates, the hydrogen sulfates, and the chlorides. By the term "coco" is meant fatty acid groups which are present in the fatty acids of coconut oil. Such acids containing 8–18 carbon atoms per molecule, with the acids containing 12–14 carbon atoms predominating.

The laundry softener concentrates according to the invention can contain up to a total of 35% by weight of a solubilizer or of said solubilizer and water, based on the amount of softener. As solubilizers there can be used isopropanol, ethanol, glycol, benzenesulfonates, toluenesulfonates, xylenesulfonates, or wetting agents such as, e.g., non-ionic surfactants such as nonylphenol ethoxylates, fatty alcohol ethoxylates, and the like.

The laundry softener concentrate according to the invention is a freely-flowing powder. It is stable in storage and, because of its powdery nature, requires only a small packaging space. It can be easily metered, and can if desired or necessary be combined with detergent.

EXAMPLES

1. The laundry softener REWOQUAT® CR 3099 (100%) (difatty acid ester dimethylammonium methosulfate) was heated to 60° C. and mixed with 31% by weight of the silicon dioxide Sipernat 22 S. The laundry softener concentrate obtained as a flowable powder.

2. The 75% laundry softener dispersion REWOQUAT® W 7500 (75% quaternary imidazolinium-dialkyl compound with 25% isopropanol) was mixed with 34% by weight Sipernat 22. The laundry softener concentrate obtained was a flowable powder.

3. The 75% laundry softener dispersion REWOQUAT® W 7500 H was first melted and then mixed with 35% by weight Sipernat 50. The laundry softener concentrate obtained was a flowable powder.

4. The 75% laundry softener dispersion Präpagen WK (distearyl dimethylammonium chloride) was mixed with 32% Sipernat 50 S. The laundry softener concentrate obtained was a flowable powder.

The silicon dioxide Sipernat 22 used is a precipitated and spray-dried silicon dioxide. It has the following physical and chemical characteristics:

| | | |
|---|---|---|
| BET surface | $m^2/g$ | 190 |
| Average size of primary particles | nm | 18 |
| Tamped density by DIN 53,194 | g/l | 270 |
| Loss on drying by DIN 55,921 (2 hours at 105° C.) | % | 6 |
| Loss on ignition by DIN 55,921, based on the substance dried at 105° C. (2 hours at 1,000° C.) | % | 5 |
| pH value by DIN 53,200 (in 5% aqueous dispersion) | | 6.3 |
| $SiO_2$ (based on the substance ignited for 2 hours at 1,000° C.) | % | 98 |
| $Al_2O_3$ (based on the substance ignited for 2 hours at 1,000° C.) | % | 0.2 |
| $Na_2O$ (based on the substance ignited for 2 hours at 1,000° C.) | % | 1 |
| $Fe_2O_3$ (based on the substance ignited for 2 hours at 1,000° C.) | % | 0.03 |
| CaO (based on the substance ignited for 2 hours at 1,000° C.) | % | — |
| $SO_3$ (based on the substance ignited for 2 hours at 1,000° C.) | % | 0.8 |
| $Cl^-$ (based on the substance ignited for 2 hours at 1,000° C.) | % | — |
| Sieve residue by DIN 53,580 (according to Mocker, 45 μm) | % | 0.5 |

The silicon dioxide Sipernat 22 S used is a spray-dried and milled precipitated silicon dioxide with the following physical and chemical characteristics:

| | | |
|---|---|---|
| BET surface | $m^2/g$ | 190 |
| Average size of primary particles | nm | 18 |
| Tamped density by DIN 53,194 | g/l | 120 |
| Loss on drying by DIN 55,921 (2 hours at 105° C.) | % | 6 |
| Loss on ignition by DIN 55,921, based on the substance dried at 105° C. (2 hours at 1,000° C.) | % | 5 |
| pH value by DIN 53,200 (in 5% aqueous dispersion) | | 6.3 |
| $SiO_2$ (based on the substance ignited for 2 hours at 1,000° C.) | % | 98 |
| $Al_2O_3$ (based on the substance ignited for 2 hours at 1,000° C.) | % | 0.2 |
| $Na_2O$ (based on the substance ignited for 2 hours at 1,000° C.) | % | 1 |
| $Fe_2O_3$ (based on the substance ignited for 2 hours at 1,000° C.) | % | 0.03 |
| CaO (based on the substance ignited for 2 hours at 1,000° C.) | % | — |
| $SO_3$ (based on the substance ignited for 2 hours at 1,000° C.) | % | 0.8 |
| $Cl^-$ (based on the substance ignited for 2 hours at 1,000° C.) | % | — |
| Sieve residue by DIN 53,580 (according to Mocker, 45 μm) | % | 0.2 |

The silicon dioxides Sipernat 50 and 50S used are spray-dried precipitated silicon dioxides with the following physical and chemical characteristics:

| | | Sipernat 50 | Sipernat 50S |
|---|---|---|---|
| BET surface | $m^2/g$ | 450 | 450 |
| Tamping density(1) | g/l | 200 | 100* |
| Loss on drying(2) (2 hours at 105° C.) | g | 6 | 6 |
| Loss on ignition(2)(5) | % | 5 | 5 |
| pH value(3) (in 5% aqueous dispersion) | | 7 | 7 |
| $SiO_2$ content(6) | % | 99 | 99 |
| $Al_2O_3$ content(6) | % | 0.2 | 0.2 |
| $Na_2O$ content(6) | % | 0.3 | 0.3 |
| $Fe_2O_3$ content(6) | % | 0.33 | 0.33 |
| $SO_3$ content(6) | % | 0.4 | 0.4 |
| Sieve residue(4) (according of Mocker 45 μm) | % | 0.5 | 0.1 |
| Dibutylphthalate uptake | % | 330 | 330 |

(1)by DIN 53,194
(2)by DIN 55,921
(3)by DIN 53,200
(4)by DIN 53,580
(5)based on the substance dried at 105° C. for 2 hours
(6)based on the substance ignited at 1,000° C. for 2 hours
*uncompressed product

What is claimed is:

1. A laundry softener concentrate which comprises a mixture of at least one laundry softener and synthetic spray dried precipitated silicon dioxide, wherein the laundry softener is a cationic nitrogen-containing compound selected from the group consisting of a quaternary ammonium compound and an amine salt, said compound containing one or two straight-chain organic residues containing at least 8 carbon atoms, one of said residues containing from 12 to 22 carbon atoms.

2. The laundry softener concentrate according to claim 1, wherein the synthetic silicon dioxide is present in an amount whereby the concentrate is in the form of a free-flowing powder.

3. The laundry softener concentrate according to claim 1 containing up to 50% by weight of said synthetic silicon dioxide.

4. The laundry softener concentrate according to claim 1 containing from about 50% to about 70% by weight laundry softener and from about 30% to about 50% by weight synthetic silicon dioxide.

5. The laundry softener concentrate according to claim 1 containing from 30% to 35% by weight synthetic silicon dioxide.

6. The laundry softener concentrate according to claim 1, wherein the synthetic silicon dioxide is a milled spray-dried precipitated silicon dioxide.

7. The laundry softener concentrate according to claim 1, wherein the laundry softener has the formula:

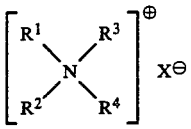

wherein $R^1$ is a long-chain aliphatic residue containing from 8 to 22 carbon atoms or a fatty acid ester group; $R^2$ is a long-chain aliphatic residue containing from 8 to 22 carbon atoms, an alkyl residue containing from 1 to 6 carbon atoms, an aryl, aryloxy, alkoxy or aralkyl residue containing from 6 to 28 carbon atoms or a fatty acid ester group; $R^3$ and $R^4$ are alkyl or hydroxyalkyl residues containing from 1 to 6 carbon atoms or hydroxypolyalkoxyalkyl residues containing from 4 to 20 carbon atoms; and X denotes an anion forming a water-soluble salt.

8. The laundry softener concentrate according to claim 7, wherein the nitrogen is a ring nitrogen and the residues $R^2$ and $R^3$ are replaced by a ring formed from 4 or 5 carbon atoms.

9. The laundry softener concentrate according to claim 1, wherein the laundry softener has the formula:

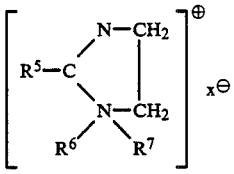

wherein $R^5$ is a long-chain aliphatic residue containing from 8 to 22 carbon atoms, $R^6$ is an alkyl residue containing from 1 to 6 carbon atoms, $R^7$ is an alkylamido residue containing from 8 to 22 carbon atoms or a hydroxyalkyl residue containing from 2 to 6 carbon atoms.

10. The laundry softener concentrate according to claim 1, wherein the softener is a water-soluble sulfate, hydrogen sulfate or chloride of primary tall oil amine, primary coco amine, primary hydrogenated tall oil amine, tall oil-1,3-propylenediamine, oleyl-1,3-propylenediamine, or coco-1,3-propylenediamine.

11. The laundry softener concentrate according to claim 1 also containing up to 35% by weight based on the weight of the laundry softener of a solubilizer for said softener or a combination said solubilizer and water.

12. The laundry softener concentrate according to claim 11, wherein the solubilizer is a member selected from the group consisting of isopropanol, ethanol, glycol, a benzenesulfonate, a toluenesulfonate, a xylenesulfonate and a non-ionic surfactant.

13. The laundry softener concentrate according to claim 11, wherein the synthetic silicon dioxide is present in an amount whereby the concentrate is in the form of a free-flowing powder.

14. The laundry softener concentrate according to claim 11 containing up to 50% by weight of said synthetic silicon dioxide.

15. The laundry softener concentrate according to claim 11 containing from about 50% to about 70% by weight laundry softener and from about 30% to about 50% by weight synthetic silicon dioxide.

16. The laundry softener concentrate according to claim 11 containing from 30% to 35% by weight synthetic silicon dioxide.

17. The laundry softener concentrate according to claim 11, wherein the synthetic silicon dioxide is a milled spray-dried precipitated silicon dioxide.

18. The laundry softener concentrate according to claim 11, wherein the laundry softener has the formula:

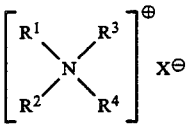

wherein $R^1$ is a long-chain aliphatic residue containing from 8 to 22 carbon atoms or a fatty acid ester group; $R^2$ is a long-chain aliphatic residue containing from 8 to 22 carbon atoms, an alkyl residue containing from 1 to 6 carbon atoms, an aryl, aryloxy, alkoxy or aralkyl residue containing from 6 to 28 carbon atoms or a fatty acid ester group; $R^3$ and $R^4$ are alkyl or hydroxyalkyl residues containing from 1 to 6 carbon atoms or hydroxypolyalkoxyalkyl residues containing from 4 to 20 carbon atoms; and X denotes an anion forming a water-soluble salt.

19. The laundry softener concentrate according to claim 18, wherein the nitrogen is a ring nitrogen and the residues $R^2$ and $R^3$ are replaced by a ring formed from 4 or 5 carbon atoms.

20. The laundry softener concentrate according to claim 11, wherein the laundry softener has the formula:

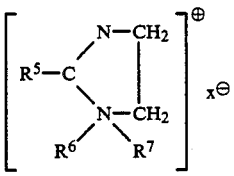

wherein $R^5$ is a long-chain aliphatic residue containing from 8 to 22 carbon atoms, $R^6$ is an alkyl residue containing from 1 to 6 carbon atoms, $R^7$ is an alkylamido residue containing from 8 to 22 carbon atoms or a hydroxy-alkyl residue containing from 2 to 6 carbon atoms.

21. The laundry softener concentrate according to claim 1, wherein the softener is a water-soluble sulfate, hydrogen sulfate or chloride of primary tall oil amine, primary coco amine, primary hydrogenated tall oil amine, tall oil-1,3-propylenediamine, oleyl-1,3-propylenediamine, or coco-1,3-propylenediamine.

* * * * *